US005553702A

United States Patent [19]

Walsh

[11] Patent Number: 5,553,702

[45] Date of Patent: Sep. 10, 1996

[54] KEEPSAKE HOLDER

[76] Inventor: Karen Walsh, 1 High Trail, New Milford, Conn. 06776

[21] Appl. No.: 460,312

[22] Filed: Jun. 2, 1995

[51] Int. Cl.[6] ..... A45C 15/00

[52] U.S. Cl. ..... 206/38; 206/232; 206/486; 220/522; 220/555

[58] Field of Search ..... 206/38, 486, 472, 206/473, 232; 220/521, 522, 553, 555, 4.22, 340

[56] References Cited

U.S. PATENT DOCUMENTS

| | | | |
|---|---|---|---|
| D. 347,338 | 5/1994 | Randle | D6/470 |
| 3,702,508 | 11/1972 | Netter | 35/59 |
| 4,524,867 | 6/1985 | Klein et al. | 206/232 |
| 4,742,911 | 5/1988 | Manuel | 206/232 |
| 5,190,127 | 3/1993 | Cummings | 206/232 |
| 5,269,083 | 12/1993 | Vampatella et al. | 40/24.1 |
| 5,289,915 | 3/1994 | Queen | 206/38 |
| 5,318,327 | 6/1994 | Daneshvar | 283/117 |
| 5,351,818 | 10/1994 | Daneshvar | 220/522 |
| 5,462,170 | 10/1995 | Colgate | 206/38 |

FOREIGN PATENT DOCUMENTS

| | | | |
|---|---|---|---|
| 2319334 | 11/1974 | Germany | 206/473 |

*Primary Examiner*—David T. Fidei

*Attorney, Agent, or Firm*—Ware, Fressola, Van Der Sluys & Adolphson

[57] ABSTRACT

A keepsake holder (10) comprises a first housing section (12), a second housing section (13), and at least one hinge (15) mounted adjacent to an edge (17,18) of the first and second housing sections for allowing relative movement therebetween. A keepsake compartment (30) is formed in the second housing section for receiving a keepsake (47), and a retention device (50) is provided for retaining the keepsake in the keepsake compartment, the retention device being formed of a transparent material for allowing viewing of the keepsake contained in the keepsake compartment. At least one further compartment (32) is formed in the first or second housing sections for holding a picture (65) of a person, article or event associated with the keepsake. A third compartment (35) is formed in either the first or second housing sections for holding a certificate (81) or other written indicia indicating the source, date and/or other pertinent information related to the keepsake. A catch (26) is provided on an edge of the first and second housing compartments opposite the hinge for holding the first and second housing sections together.

20 Claims, 4 Drawing Sheets

KEEPSAKE HOLDER

TECHNICAL FIELD

The present invention relates to a keepsake holder, and more particularly, to a keepsake holder for holding and identifying one or more personal items such as keepsakes and momentos.

BACKGROUND OF THE INVENTION

Keepsakes, momentos and other remembrances (herein after collectively referred to as keepsakes) provide valuable reminders of significant events in ones life. For example, the practice of retaining a lock of hair from a child or loved one is well known, the lock of hair acting as a reminder of the special feelings felt for that child or loved one.

Typically, such keepsakes are kept with other remembrances, and are placed in a card, envelope or other like holder for retention of the keepsake. A problem associated with retaining a keepsake in this manner is that cards and envelopes may deteriorate with time and may become unsuitable for holding the keepsake over a long period of time. Additionally, such a card or envelope is not suitable for displaying the keepsake, and therefore does not serve the intended purpose of reminding the owner of the person, article or event associated with the keepsake.

SUMMARY OF THE INVENTION

An object of the present invention is to provide a keepsake holder for holding a keepsake or memento, the holder providing for the secure and safe long term retention of the keepsake and also providing a refined appearance for displaying the keepsake.

Another object of the present invention is to provide a keepsake holder which provides for the identification of the keepsake contained therein.

A still further object the present invention is to provide a keepsake holder which provides a picture compartment for holding a photograph of a person, article or event associated with the keepsake.

According to the present invention, a keepsake holder comprises a first housing section, a second housing section, and at least one hinge mounted adjacent to an edge of the first and second housing sections for allowing relative movement therebetween. A keepsake compartment is formed in the second housing section for receiving a keepsake, and retention means are provided for retaining the keepsake in the keepsake compartment, the retention means being formed of a transparent material for allowing viewing of the keepsake contained in the keepsake compartment.

According further to the present invention, at least one further compartment is formed in the first or second housing sections for holding a picture of a person, article or event associated with the keepsake.

A still further object of the present invention is to provide a third compartment in either the first or second housing sections for holding a certificate or other written indicia indicating the source, date and/or other pertinent information related to the keepsake.

According still further to the present invention, a catch is provided on an edge of the first and second housing compartments opposite the hinge for holding the first and second housing sections together.

The keepsake holder of the present invention provides for the secure retention of a keepsake while providing a holder of refined appearance. The keepsake holder allows for viewing of the keepsake retained in a keepsake compartment of the holder through a retention window which is formed of a transparent material. Additionally, the keepsake holder provides additional compartments for holding a picture of the person, article or event associated with the keepsake and for holding a certificate or other written material describing details of the keepsake. The keepsake holder first housing section and second housing section provide for display of the keepsake in a book or picture frame fashion and also provide for easy storage of the keepsake when the housing sections are closed together and retained in the closed condition by a catch.

The foregoing and other objects, features and advantages of the present invention will become more apparent in light of the following detailed description of exemplary embodiments thereof, as illustrated in the accompanying drawings.

BEST MODE FOR CARRYING OUT THE INVENTION

Figure 1:
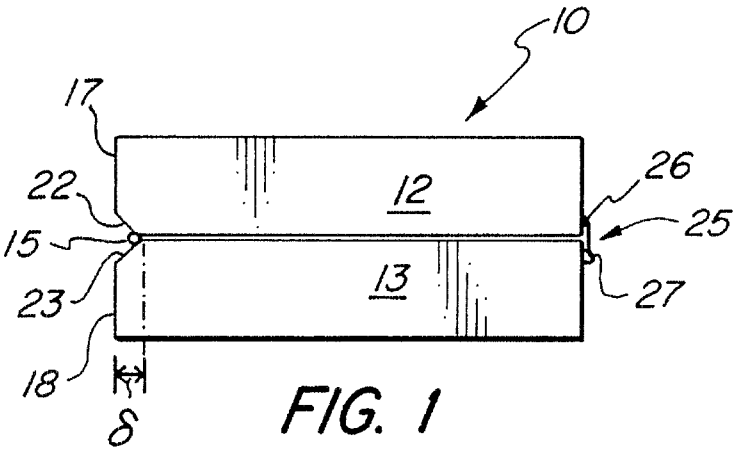
FIG. 1 is a side view of the keepsake holder of the present invention with a first housing section and a second housing section closed together about a hinge.

Referring to FIG. 1, the keepsake holder 10 comprises a top housing section 12 and a bottom housing section 13 connected on one edge by at least one hinge 15. The top and the bottom housing sections 12, 13 are manufactured from wood. However, it will be understood by those skilled in the art that the top and bottom sections may be made of any suitable material such as plastic, injection molded plastic, cardboard, plaster, mineral, etc.

Figure 2:
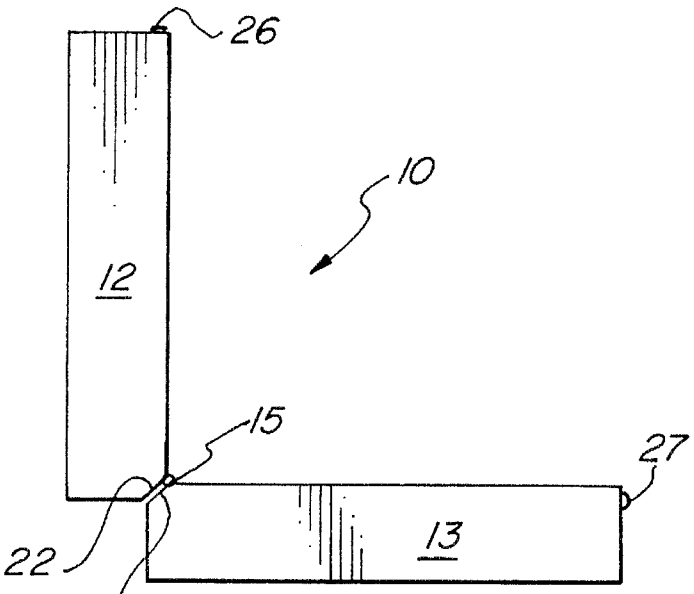
FIG. 2 is a side view of the keepsake holder of FIG. 1 showing the housing sections opened about the hinge at a 90° angle with respect to one another.
Figure 3:
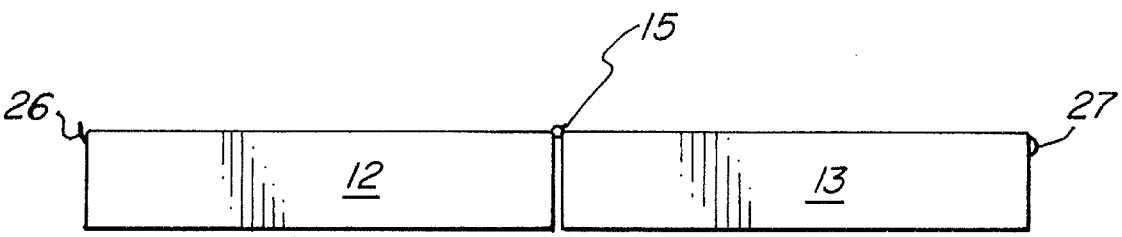
FIG. 3 is a side view of a second embodiment of the keepsake holder of FIG. 1 showing the housing sections opened about the hinge at a 180° angle with respect to one another.

As illustrated in FIG. 1, the hinge 15 is offset from the extreme edges, 17, 18 of the top and bottom sections, 12, 13, respectively, by an offset distance δ. Additionally, the areas of the top and bottom sections 12, 13 between the hinge 15 and the edges 17, 18 (the offset distance δ) are angled or bevelled 22, 23. This combination of the offset hinge 15 and the bevelled sections 22, 23 provides for the opening of the top and bottom sections with respect to one another approximately 90° as shown in FIG. 2. Alternatively, as illustrated in FIG. 3, the hinge may be located at the extreme edges 17, 18 of the top and bottom sections 12, 13 so that the sections may be opened 180° with respect to one another. However, as will be understood by those skilled in the art, the placement of a hinge (the selection of the offset distance δ), and the degree of the angle of the bevels 23, 24 may be selected to provide the desired degree of opening between the top and the bottom sections 12, 13.

Referring again to FIG. 1, a catch 25 is provided on a side of the top and bottom sections 12, 13 so that when the keepsake holder is in the closed or shut position, as illustrated in FIG. 1, the top and the bottom sections 12, 13 may be retained against each other. The catch 25 comprises a swinging latch 26 mounted on the top housing section 12, and a hook or eye 27 mounted on the bottom housing section 13. The end of the swinging latch 26 is received in the eye 27 for securely attaching the top and the bottom sections 12, 13 together. Alternatively, any suitable latch combination, as is well known in the art, may be utilized on the top and bottom sections 12, 13 for retaining the top and bottom sections 12, 13 in the closed positions as illustrated in FIG. 1.

Figure 4:
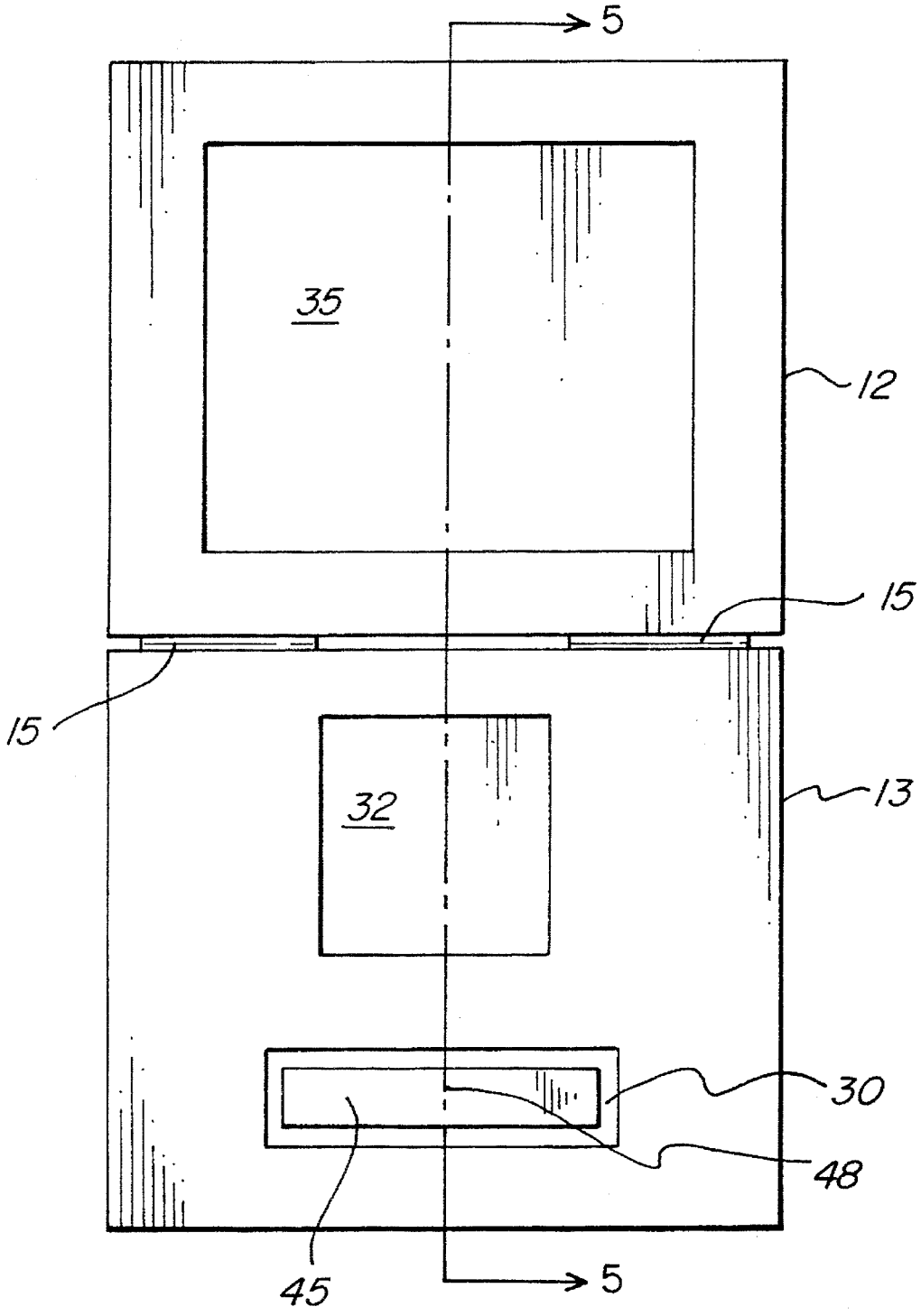
FIG. 4 is a front view of the keepsake holder of FIG. 2 in the opened condition.

Referring now to FIGS. 2 and 4, when the keepsake holder 10 is in the open position, various compartments within the keepsake holder 10 are exposed for viewing. The bottom section 13 comprises a keepsake holder compartment 30 and a photograph compartment 32. Additionally, the top section 12 includes a certificate compartment 35. Referring also to FIG. 4, the compartments 30, 32, 35 are formed in the top and bottom sections with tapered or bevelled edges such that the back or deepest part of each compartment has the widest dimensions, and the compartment narrows as it approaches an opening of each compartment.

Figure 5:
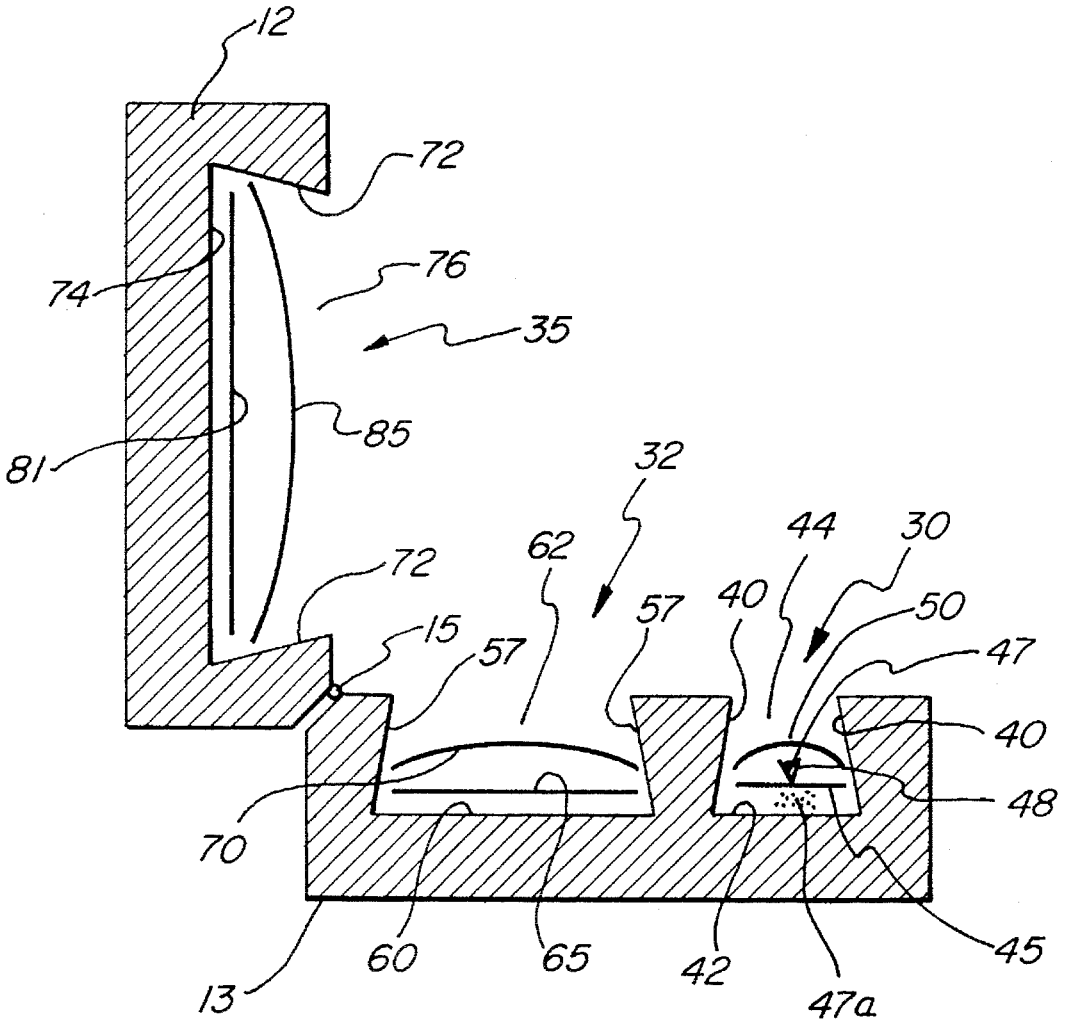
FIG. 5 is a cross-sectional view of the keepsake holder taken along line 5—5 of FIG. 4.

Referring now to FIG. 5, the keepsake compartment 30 comprises tapered or bevelled edges 40 which provide the compartment 30 with its widest dimension at a rear surface 42 of the compartment and narrows approaching an opening 44 of the compartment 30. The beveled edges 40 may be formed by making a router cut in the bottom section 13. A mounting surface 45 is placed in the compartment 30 for retaining or mounting a keepsake 47. The mounting surface 47 comprises a twist tie 48, elastic, adhesive surface or other suitable retention means for mounting a keepsake within the compartment 30. Alternatively, the keepsake may be placed directly in the compartment 30 as shown in phantom at 47*a*. To retain the keepsake 47 and mounting surface 45 in the compartment 30, a retaining device 50 is provided which is received in the compartment 30 and holds the keepsake holder 40 and keepsake 47 within the compartment 30. The retaining device is a resiliently deformable transparent material having a length and width which is approximately the same or slightly larger than the length and width of the rear surface 42 of the compartment 30. Therefore, when the retaining device 50 is received in the compartment 30, it comes in contact with the bevelled edges 40 and flexes to thereby retain the keepsake holder 45 and keepsake 47 within the compartment 30. Additionally, due to the transparent nature of the retaining device 50, the keepsake may be viewed through the retaining device 50. Therefore, the retaining device 50 serves a dual function of retaining the keepsake 47 within the compartment 30 and providing viewing of the keepsake 47.

The photograph compartment 32 and the certificate compartment 35 are of a similar construction as the keepsake compartment 30. The photograph compartment 32 includes bevelled edges or sidewalls 57 which provides the compartment with its widest dimension and a rear surface 60 of the photograph compartment 32 and narrows approaching an opening 62 of the compartment 32. The bevelled edges 57 may be formed by making a router cut in the bottom section 13 in the area of the photograph compartment 32. A photograph 65 may then be received in the compartment. The dimensions of the photograph may be selected to be approximately equal to the dimensions of the rear surface 60 of the photograph compartment 32 such that the photograph 65 must be flexed to fit through the opening 62 of the photograph compartment 32 and is then securely retained in the photograph compartment 32 by the bevelled sidewalls 57. To provide for a more refined appearance and to provide further retention of the photograph 65 within the photograph compartment 32, a retaining device 70, such as the resiliently deformable transparent retaining device 50 of the keepsake compartment 30, is received in the photograph compartment 32.

The certificate compartment 35 also includes beveled sidewalls 72 such that the rear surface 74 of the compartment has a wider dimension than an opposing opening 76 of the certificate compartment 35. A certificate 81 may be received int he compartment in a similar manner as the photograph 65 is received in the photograph compartment 32. A retaining means 85 may also be used to help retain the certificate 81 within the certificate compartment 35.

Although the invention is described as having top and bottom sections 12, 13 made of wood and attached along an edge by a hinge 15 with the keepsake, photograph and certificate compartments 30, 32, 35 formed by a router cut in the wood, it will be understood by those skilled in the art that the invention may be implemented by using plastic, for example injection molded plastic, with the hinge 15 being a living hinge and the compartments 30, 32, 35 being molded in the plastic. Any other suitable material may be used for the top and bottom sections 12, 13 and the compartments may be formed in the selected material by any suitable method as desired.

Figure 6:
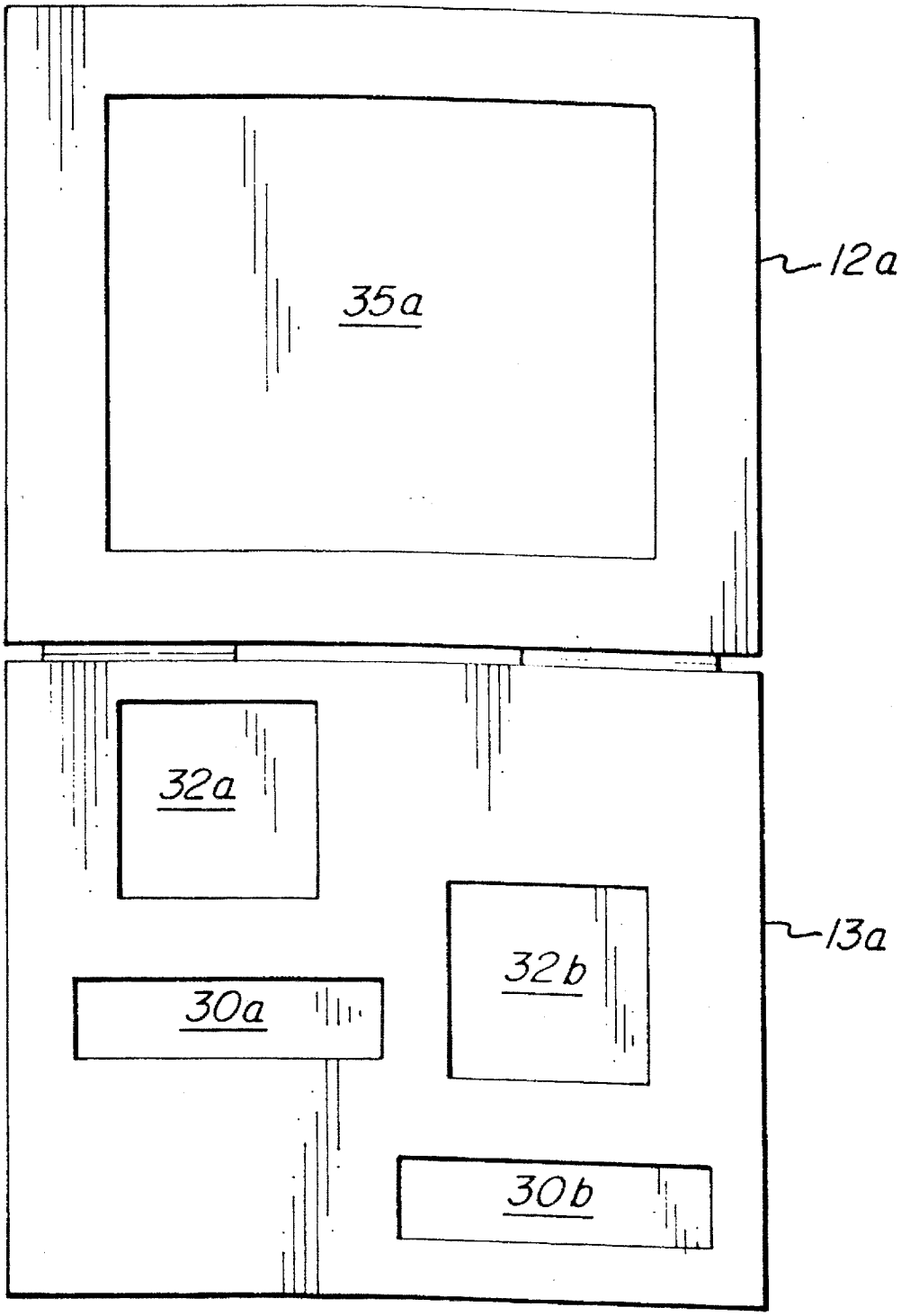
FIG. 6 is a front view of a third embodiment of the keepsake holder of FIG. 2 in the opened condition.

Additionally, although the invention is illustrated as including a keepsake compartment, a picture compartment, and a certificate compartment, it will be understood by those skilled in the art that the invention may be provided with any combination, number and/or shape of compartments as desired. For example, as shown in FIG. 6, two picture compartments 326i a, 32*b* and two keepsake compartments 30*a*, 30*b* may be provided in the bottom section 13*a*. Alternatively, the keepsake and picture compartments may be provided in the top section 12*a* and the certificate compartment 35*a* may be provided in the bottom section 13*a*, all as desired.

Although the invention has been described and illustrated with respect to exemplary embodiments thereof, it will be understood by those skilled in the art that various other changes, omissions and additions may be made therein and thereto without departing from the spirit and scope of the present invention.

I claim:

1. A keepsake holder for holding a keepsake, comprising:

a first housing section;

a second housing section;

at least one hinge mounted adjacent to an edge of said first and second housing sections for allowing relative movement therebetween;

at least one keepsake compartment formed in said second housing section for receiving the keepsake, each keepsake compartment including tapered side walls which terminate in a rear surface of each keepsake compartment, said tapered side walls defining an opening in each keepsake compartment, said rear surface of each keepsake compartment having wider dimensions than said opening in each keepsake compartment; and retention means received in said keepsake compartment for retaining the keepsake in said keepsake compartment, said retention means being formed of a transparent material for allowing viewing of the keepsake within said keepsake compartment.

2. A keepsake holder as claimed in claim 1, further comprising at least one picture compartment formed in one of said housing sections for receiving a photograph.

3. A keepsake holder as claims in claim 2, further comprising at least one certificate compartment formed in one of said housing sections for receiving a certificate.

4. A keepsake holder as claimed in claim 3, wherein said picture and certificate compartments comprise tapered side walls which terminate in a rear surface of said compartments, said tapered side walls defining an opening in said compartments, said rear surface of said compartments having wider dimensions than said opening in said compartments.

5. A keepsake holder as claimed in claim 4, wherein said retention means is formed of a resiliently deformable transparent material.

6. A keepsake holder as claimed in claim 5, wherein the dimensions of said retention means are approximately the same or slightly larger than the dimensions of said rear surface of said keepsake compartment.

7. A keepsake holder as claimed in claim 4 further comprising retention means also received in said picture compartment and said certificate compartment.

8. A keepsake holder as claimed in claim 7, wherein said retention means is formed of a resiliently deformable transparent material.

9. A keepsake holder as claimed in claim 8, wherein the dimensions of said retention means received in each corresponding compartment are approximately the same or slightly larger than the dimensions of said rear of each corresponding compartment.

10. A keepsake holder as claimed in claim 1, further comprising a mounting surface received in said keepsake compartment, said mounting surface having mounting means for mounting the keepsake, said mounting surface being retained in said keepsake compartment by said retention means.

11. A keepsake holder as claimed in claim 10, wherein said means for mounting is a twist tie.

12. A keepsake holder as claimed in claim 10, wherein said means for mounting is elastic.

13. A keepsake holder as claimed in claim 1, further comprising catch means mounted on said first and second housing sections for retaining said housing sections in a closed position.

14. A keepsake holder as claimed in claim 1 wherein said hinge is offset a distance δ from said edges of said first and second housing sections, and wherein said edges are beveled, said offset distance δ and the degree of said bevel being selected to control an angle between said first and second housing sections when in an open position.

15. A keepsake holder for holding a keepsake, comprising:

a first housing section;

a second housing section;

at least one hinge mounted adjacent to an edge of said first and second housing sections for allowing relative movement therebetween;

at least one keepsake compartment formed in said second housing section for receiving the keepsake;

retention means received in said keepsake compartment for retaining the keepsake in said keepsake compartment, said retention means being formed of a transparent material for allowing viewing of the keepsake within said keepsake compartment; and a mounting surface received in said keepsake compartment, said mounting surface having mounting means for mounting the keepsake, said mounting surface being retained in said keepsake compartment by said retention means.

16. A keepsake holder as claims in claim 15, further comprising at least one additional compartment formed in one of said housing sections for receiving a certificate or a picture, said additional compartment also including retention means received in said additional compartment for retaining the certificate or picture therein, said retention means being formed of a transparent material for allowing viewing of the picture or certificate within said additional compartment.

17. A keepsake holder as claimed in claim 16, wherein said compartments comprise tapered side walls which terminate in a rear surface of each compartment, said tapered side walls defining an opening in each compartment, said rear surface of each compartment having wider dimensions than said opening in each compartment.

18. A keepsake holder as claimed in claim 17, wherein said retention means is formed of a resiliently deformable transparent material having dimensions which are approximately the same or slightly larger than the dimensions of said rear surface of each compartment.

19. A keepsake holder as claimed in claim 15 wherein said hinge is offset a distance δ from said edges of said first and second housing sections, and wherein said edges are beveled, said offset distance δ and the degree of said bevel being selected to control an angle between said first and second housing sections when in an open position.

20. A keepsake holder for holding a keepsake, comprising:

a first housing section;

a second housing section;

at least one hinge mounted adjacent to an edge of said first and second housing sections for allowing relative movement therebetween, wherein said hinge is offset a distance δ from said edges of said first and second housing sections, and wherein said edges are beveled, said offset distance δ and the degree of said bevel being selected to control an angle between said first and second housing sections when in an open position;

at least one keepsake compartment formed in said second housing section for receiving the keepsake; and retention means received in said keepsake compartment for retaining the keepsake in said keepsake compartment, said retention means being formed of a transparent material for allowing viewing of the keepsake within said keepsake compartment.

* * * * *